US009222301B2

(12) United States Patent
Dison et al.

(10) Patent No.: US 9,222,301 B2
(45) Date of Patent: Dec. 29, 2015

(54) REMOVABLE SOLAR PANEL INSERTS

(71) Applicants: Raymond A. Dison, Mineral Bluff, GA (US); Janie L. Dison, Mineral Bluff, GA (US)

(72) Inventors: Raymond A. Dison, Mineral Bluff, GA (US); Janie L. Dison, Mineral Bluff, GA (US)

(73) Assignee: BEST SOLAR CONTROL, INC., Mineral Bluff, GA (US)

( * ) Notice: Subject to any disclaimer, the term of this patent is extended or adjusted under 35 U.S.C. 154(b) by 0 days.

(21) Appl. No.: 14/259,221

(22) Filed: Apr. 23, 2014

(65) Prior Publication Data

US 2014/0318048 A1 Oct. 30, 2014

Related U.S. Application Data

(60) Provisional application No. 61/815,447, filed on Apr. 24, 2013.

(51) Int. Cl.
*E06B 3/28* (2006.01)
*E06B 9/24* (2006.01)

(52) U.S. Cl.
CPC ..... *E06B 9/24* (2013.01); *E06B 2009/2488* (2013.01); *E06B 2009/2494* (2013.01)

(58) Field of Classification Search
CPC ..... E06B 9/24; E06B 2009/2488; E06B 2009/2494
USPC ..... 52/202, 203, 173.3
See application file for complete search history.

(56) References Cited

U.S. PATENT DOCUMENTS

| | | | | |
|---|---|---|---|---|
| 3,148,754 | A * | 9/1964 | Nardulli | 52/204.5 |
| 4,068,428 | A * | 1/1978 | Peterson, III | 52/202 |
| 4,409,758 | A * | 10/1983 | Dickerson et al. | 49/463 |
| 4,436,084 | A * | 3/1984 | Carlston et al. | 126/628 |
| 4,562,675 | A * | 1/1986 | Baigas et al. | 52/202 |
| 5,800,631 | A * | 9/1998 | Yamada et al. | 136/251 |
| 5,887,391 | A * | 3/1999 | Shoup | 52/202 |
| 5,937,595 | A * | 8/1999 | Miller | 52/202 |
| 6,073,675 | A * | 6/2000 | Dannaher | 160/369 |
| 6,863,112 | B1 * | 3/2005 | Ayers et al. | 160/371 |
| 7,752,816 | B2 * | 7/2010 | Gunther et al. | 52/204.66 |
| 7,900,413 | B2 * | 3/2011 | Stanley | 52/408 |
| 8,037,923 | B2 * | 10/2011 | Alkhoury et al. | 160/369 |
| 8,291,656 | B2 * | 10/2012 | Gunther et al. | 52/204.66 |
| 8,365,799 | B2 * | 2/2013 | Harris | 160/105 |
| 8,479,462 | B1 * | 7/2013 | Sahadeo et al. | 52/203 |
| 8,661,747 | B2 * | 3/2014 | Eide | 52/173.3 |
| 8,826,607 | B2 * | 9/2014 | Shiao et al. | 52/173.3 |
| 2007/0199259 | A1 * | 8/2007 | Parsley | 52/203 |
| 2008/0155911 | A1 * | 7/2008 | Reuter | 52/203 |
| 2008/0236654 | A1 * | 10/2008 | Pietrangelo et al. | 136/251 |
| 2011/0030294 | A1 * | 2/2011 | Clarson et al. | 52/203 |
| 2012/0198780 | A1 * | 8/2012 | Snowwhite | 52/173.3 |
| 2014/0021903 | A1 * | 1/2014 | Seiling | 320/101 |

* cited by examiner

*Primary Examiner* — Joshua J Michener
*Assistant Examiner* — Keith Minter
(74) *Attorney, Agent, or Firm* — Thomas | Horstemeyer, LLP

(57) ABSTRACT

Disclosed are various embodiments of systems and methods related to a removable solar panel insert for a window. In some embodiments the window is an architectural window. The removable solar panel insert may include an insert frame shaped substantially equivalent to the frame of the window and a translucent solar material securely attached to the insert frame. The translucent solar material covers an opening defined by the insert frame. The solar panel insert may be easily removed from the window.

21 Claims, 6 Drawing Sheets

REMOVABLE SOLAR PANEL INSERTS

CROSS REFERENCE TO RELATED APPLICATIONS

This application claims priority to U.S. Provisional Patent Application titled "Removable Solar Inserts" filed on Apr. 24, 2013 and assigned application No. 61/815,447, which is incorporated by reference herein in its entirety.

BACKGROUND

Sunlight projected through windows can not only project harmful ultraviolet (UV) rays into an interior space, but can also generate unwanted heat, create a glare, and damage/fade furnishings within the interior space. Also, windows may come in many different shapes and sizes creating obstacles for finding shades that may reduce the unwanted features in sunlight. In addition, the unwanted features caused by the sunlight may be seasonal such that solar protection is not required year round.

SUMMARY

Included are apparatuses for a removable solar panel insert. One embodiment of an apparatus, among others, includes a solar panel insert, comprising: an insert frame shaped substantially equivalent to a window frame, wherein size dimensions of the insert frame are smaller than size dimensions of the window frame such that the insert frame is constructed to fit within the window frame; and a translucent solar material securely affixed to the insert frame, the translucent solar material covering an opening defined by the insert frame.

Another embodiment of an apparatus, among others, includes a solar panel insert apparatus, comprising: a first frame comprising a plurality of sides, wherein a first side is connected to a first jamb of a window frame of a window and a second side is connected to a second jamb of the window frame; a second frame shaped substantially similar to the window frame, the second frame being detachably attached to the first frame and at least partially embedded within the window frame; and a fabric attached to the second frame that covers an opening defined by the second frame, the fabric designed to reduce features associated with solar light emitted through a window pane of the window.

Another embodiment of an apparatus, among others, includes a solar panel insert apparatus, comprising: means for mounting an insert frame to an architectural window; means for attaching the insert frame to the mounting means; means for reducing solar properties of sunlight projected onto the architectural window; and means for initiating a detachment of the insert frame from the mounting means.

Other embodiments, systems, methods, features, and advantages of this disclosure will be or will become apparent to one with skill in the art upon examination of the following drawings and detailed description. It is intended that all such additional apparatuses, methods, features, and advantages be included within this description and be within the scope of the present disclosure.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

In the following discussion, a general description of apparatuses and methods according to various embodiments of the present disclosure is provided, followed by a discussion of the operation of the same. Embodiments of the present disclosure relate to a solar panel insert. More specifically, disclosed herein are novel approaches to the implementation of solar insert panels that are designed to fit windows, including architectural windows, and provide seasonal and/or year round solar control. The solar panel inserts may be mounted to the window via one or more fasteners, such as, for example, Velcro®, allowing a user to easily remove and store the solar panel insert as desired. In addition, the solar material that is part of the solar panel insert may be translucent, offering visibility, while providing protection against the sun's harmful rays. The solar material may also provide UV protection and reduce the heat, glare, and fading caused by the sun that may damage an interior area and/or furnishings.

Figure 1:
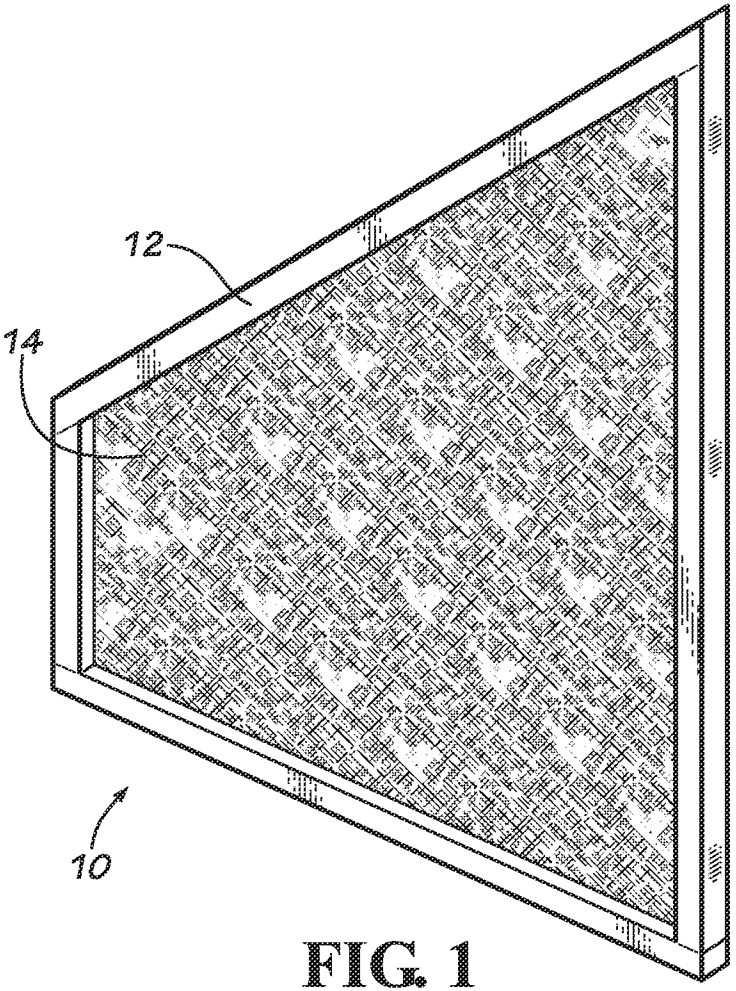
FIG. 1 is a drawing of an example of a front view of a solar panel insert according to various embodiments of the present disclosure.

Referring now to FIG. 1, shown is a drawing of an example of a front view of a solar panel insert 10, according to various embodiments of the present disclosure. The solar panel insert 10 comprises an insert frame 12 and a solar material 14. The insert frame 12 comprises one or more frame members connected together to form a shape substantially similar to a shape of a specific window. The specific window may comprise an architectural window. The one or more frame members are assembled to one another with mechanical fasteners, such as, for example, screws, bolts, nails, and/or other type of mechanical fastener. The one or more frame members may be connected to one another at the butt joints or other points of connection. The insert frame 12 defines an opening that is substantially equivalent to the size of the window pane of the window so that the view through the window pane is not obstructed by the insert frame 12. The insert frame 12 is shaped substantially similar to the shape of the window frame of the window to which the insert frame 12 may be mounted. The shape of the insert frame 12 may comprise a square, a rectangle, a trapezoid, an ellipse, an oval, an octagon, a triangle, an eyebrow, a circle, a half circle, a quarter circle, a pentagon, a heptagon, a decagon, a hexagon, or any other shape of a window or architectural window. In some embodiments, the shape of the solar panel insert 10 may be asymmetrical. The dimensions of the insert frame 12 are less than the dimensions of the window frame so that the insert frame 12 may be inserted within the window frame. In some embodiments, the insert frame 12 may constructed to be about ¼" or less in width from the window frame and about 1" or less in height from the window frame to allow for heat escape. The insert frame 12 may comprise a wood material. In some embodiments, the insert frame 12 may be stained and/or painted so that the color of the insert frame 12 substantially matches the color of the window frame and/or other desired color.

The solar material 14 comprises material of known commercial solar fabrics such as, for example, Sheerweave® products manufactured by Phifer® or other types of solar fabrics. The solar material 14 may reduce solar heat, reduce glare, provide UV protection, reduce damage related to fading of interiors and/or furnishings caused by solar light, and/or reduce other features associated with solar light. The solar material 14 may comprise a color such as, for example, a black, white, gray, and/or any other type of color. The solar material 14 may be translucent so that the outside is visible through the inside.

The solar material 14 may cover the entire opening defined by the insert frame 12 so that when the solar panel insert 10 is mounted to a window, any sunlight that is projected into an interior space from the window travels through the solar material 14. The solar material 14 may be attached to the insert frame 12 via staples, tacks, nails, adhesive glue, and/or any other type of connector and/or combination of connectors that would securely attach the solar material 14 to the insert frame 12. In some embodiments, the solar material 14 may be affixed to the back of the insert frame 12. In some embodiments, an additional frame may be affixed to the back of the insert frame 12 to conceal the solar material 14 and attachment means that are visible from the back of the insert frame 12. Accordingly, when the solar panel insert 10 is mounted to the window, the means for attaching the solar material 14 to the insert frame 12, such as, for example, staples, are not visible from the outside.

Figure 2:
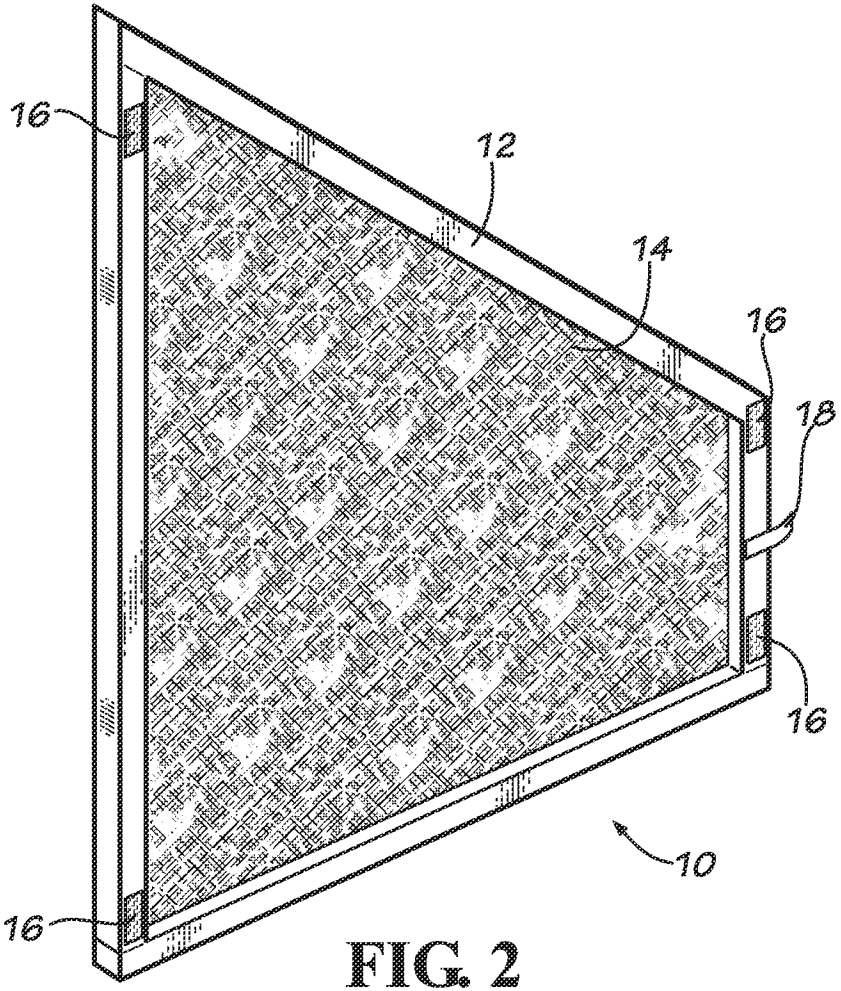
FIG. 2 is a drawing of an example of a back view the solar panel insert of FIG. 1 according to various embodiments of the present disclosure.

Moving on to FIG. 2, shown is a drawing of an example of a back view of the solar panel insert 10 according to various embodiments of the present disclosure. As previously discussed, the solar panel insert 10 comprises an insert frame 12 and solar material 14. The back face of the solar insert panel 10 may further comprise one or more first portions of a detachable fastener 16 and a removal tab 18. The one or more first portions of the detachable fastener 16 may comprise, for example, a hook portion or a loop portion of a hook and loop fastener, such as for example, Velcro®, or other type of fastener. The first portion of the fastener 16 is used to attach the solar panel insert 10 to a mounting frame 22 (FIG. 3) that may be securely mounted to a window frame 24 (FIG. 3) of a window 20 (FIG. 3) In some embodiments, the solar insert panel 10 may be attached to the mounting frame 22 via a type of detachable fastener such as, for example, one or more hook and loop fasteners, one or more magnets, one or more screws, and/or other type of detachable fastener that allows the solar panel insert 10 to be removable from the mounting frame 22.

The removal tab 18 extends from the back face of the solar panel insert 10. The removal tab 18 may comprise a material such as, for example the solar material 14, or other type of material that could be pulled by a user to initiate the removal of the solar panel insert 10 from the mounting frame 22 when the solar panel inset 12 is attached to the mounting frame 22. The removal tab 18 is long enough so that it may wrap around the outer portion of the insert frame 12 and protrude from the solar panel insert 10 when the solar panel insert 10 is attached to the window 20. In some embodiments, the removal tab 18 may comprise a handle attached to the solar panel insert 10. In other embodiments, the frame may be removed by grabbing a portion of the insert frame 12 and pulling to release.

Figure 3:
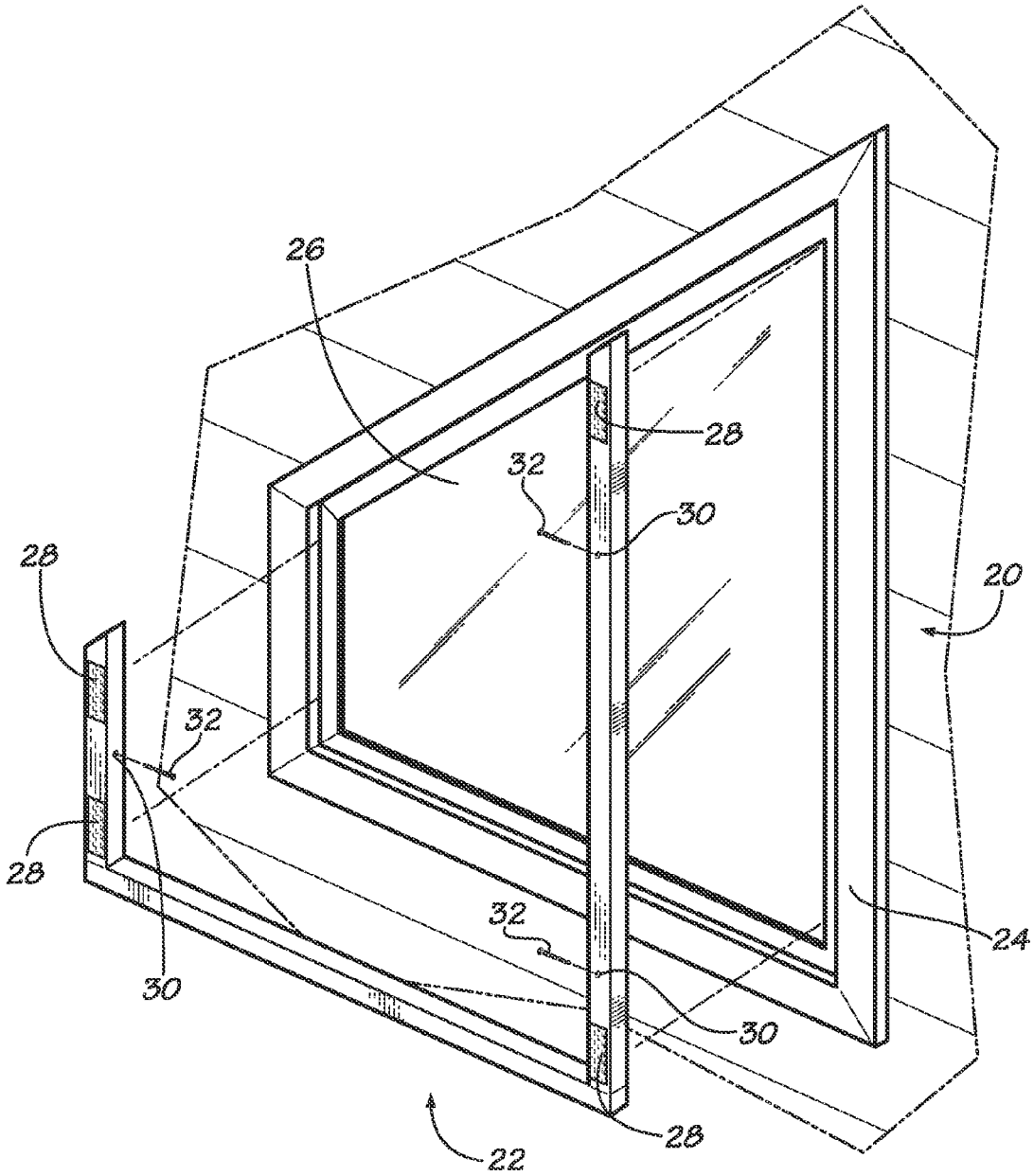
FIG. 3 is a drawing of an example of a mounting frame for mounting the solar panel insert of FIG. 1 to a window, showing how the mounting frame may be attached to the window according to various embodiments of the present disclosure.

Referring next to FIG. 3, shown is a drawing of an example of a mounting frame 22, showing how the mounting frame 22 may be attached to a window 20 according to various embodiments of the present disclosure. The window 20 comprises a window frame 24 and a window pane 26. The mounting frame 22 comprises one or more frame members which are similar in shape to one or more sides of the window frame 24. The dimensions of the one or more frame members of the mounting frame 22 are less than the dimensions of the window frame 24. The mounting frame 22 is constructed to attach to the window frame 24 without obstructing the view from the window pane 26. The one member of the mounting frame 22 may correspond to one or more of the window edges. For example the mounting frame 22 may correspond to the bottom, left, and right edges of the window 20.

The mounting frame 22 may further comprise one or more second portions of a detachable fastener 28 and one or more connector apertures 30. The one or more second portions of the detachable fastener 28 may comprise, for example, a hook portion or a loop portion of a hook and loop fastener, such as for example, Velcro®, or other type of detachable fastener. Accordingly, the one or more second portions of the detachable fastener 28 may comprise the other portions of the detachable fastener for the first portion of the detachable fastener 16 of the solar insert panel 10. For example, if the first portion of the detachable fastener 16 is a hook fastener for a hook and loop fastener, the second portion of the fastener 28 may comprise the loop fastener to connect with the hook fastener. The second portion of the detachable fastener 28 may be used to attach the mounting frame 22 to the solar insert panel 10. In some embodiments, the solar insert panel 10 may be attached to the mounting frame 22 via a detachable fastener such as, for example, one or more hook and loop fasteners, one or more magnets, one or more screws, and/or other type of detachable fastener that allows the solar panel insert 10 to be removable from the mounting frame 22.

In some embodiments, the mounting frame 22 may further comprise a leg (not shown) that may extend down from a top of window 20. The leg may comprise a fastener for attaching to the solar panel insert 10. The fastener may comprise a hook and loop fastener, magnet, and/or other type of fastener. This embodiment may be preferred for windows that have a circle top or one or more rounded edges. The leg may be clear and may comprise plastic or another type of substantially clear material that could support the solar panel insert 10 when attached to the mounting frame 22.

The one or more connector apertures 30 comprise apertures that accept connecting means for securing the mounting frame 22 to the window 20. In some embodiments, the mounting frame 22 may be connected to the window 20 with one or more mechanical fasteners 32 such as, for example, screws, nails, bolts, and/or other type of mechanical fastener that can securely mount the mounting frame 22 to the window. In other embodiments, the mounting frame 22 may be mounted to the window 20 via a hook and loop fastener, a magnet, adhesive glue and/or any other type of fastener that would securely mount the mounting frame 22 to the window 20. The mounting frame 22 may be mounted to one or more window jambs of the window 20 or other part of the window frame 24. For example, one member of the mounting frame 22 may be secured to one window jamb via a mechanical fastener 32 and a second member of the mounting frame 22 may be secured to a second window jamb via a second mechanical fastener 32.

Figure 4:
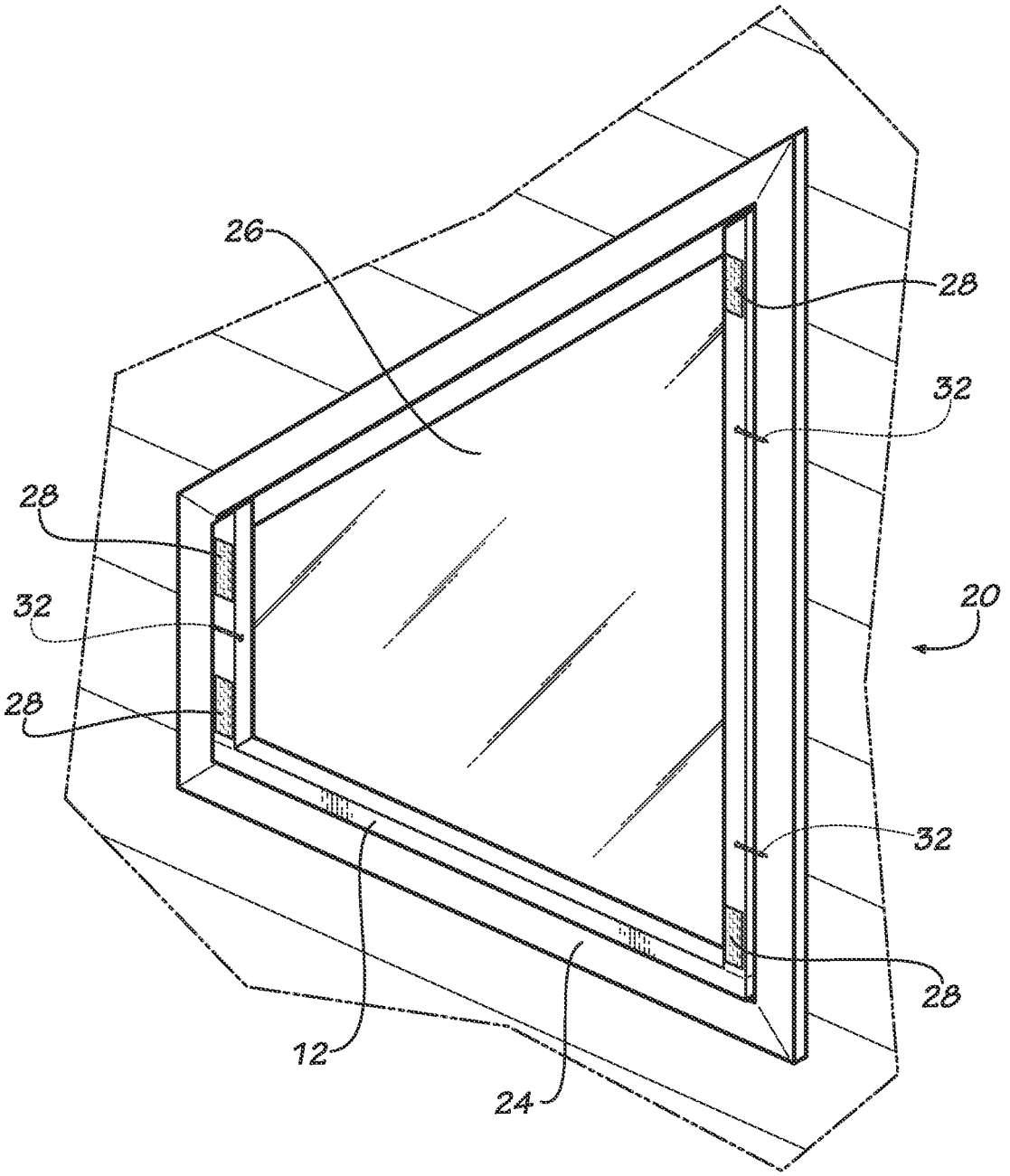
FIG. 4 is a drawing of an example of the mounting frame of FIG. 3, showing the mounting frame mounted to a window according to various embodiments of the present disclosure.

Turning now to FIG. 4, shown is a drawing of an example of the mounting frame 22 mounted to the inside of the window frame 24 of the window 20. The mounting frame 22 shown in FIG. 4 does not obstruct the view from the window pane 26 of the window 20. In addition, the mounting frame 22 is secured to the window frame 24 via the mechanical fasteners 32. The front face of the mounting frame 22 includes the second portions of the detachable fasteners 28 used to attach solar panel insert 10 to the mounting frame 22.

Figure 5:
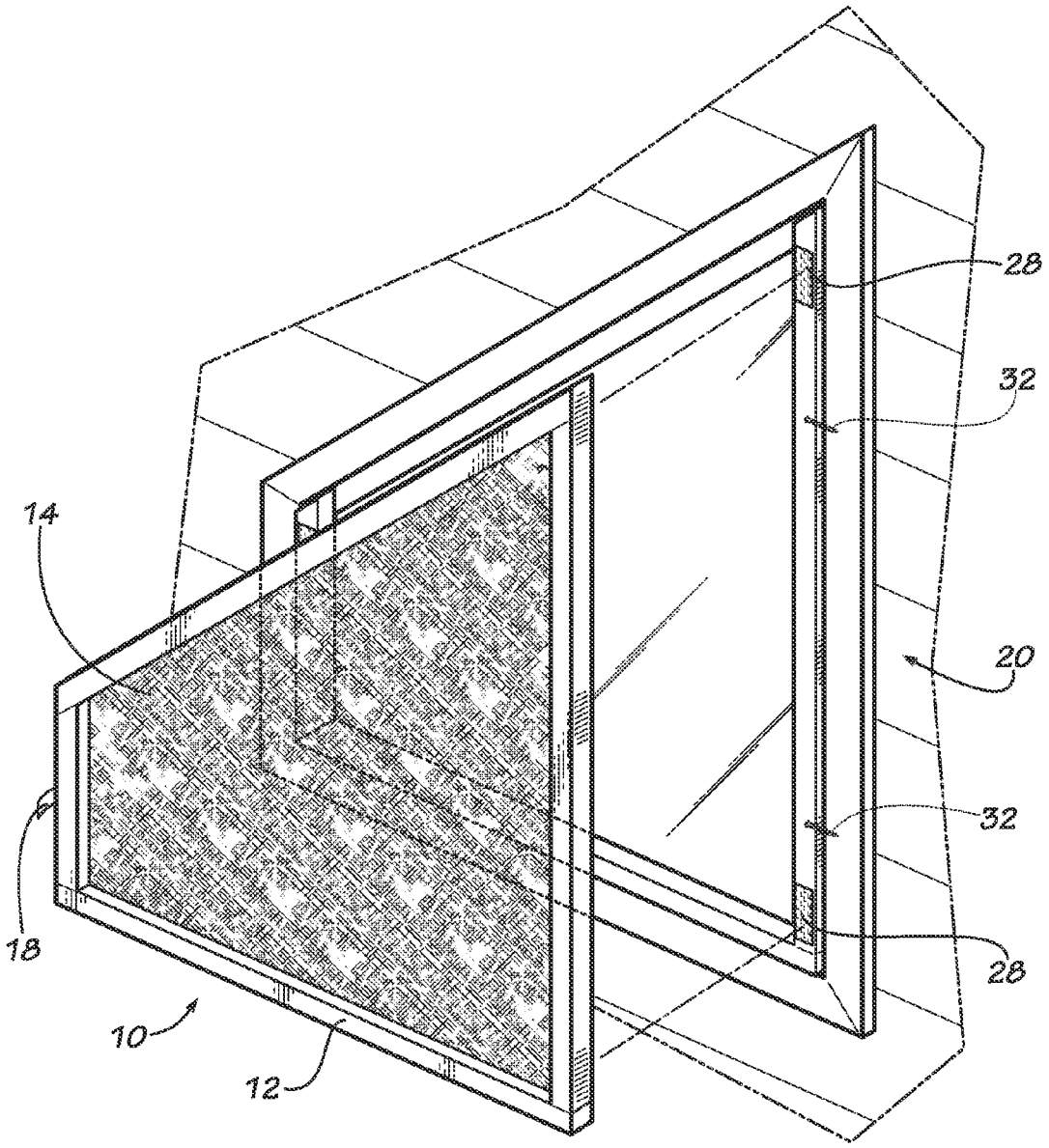
FIG. 5 is a drawing of an example of the solar panel insert of FIG. 1, showing how the solar insert panel may attach to the mounting frame according to various embodiments of the present disclosure.

Referring next to FIG. 5, shown is a drawing of an example of the solar panel insert 10, showing how the solar panel insert 10 may be detachably attached to the window 20 via the mounting frame 22. As shown in FIG. 5, the mounting frame 22 is securely attached to the window 20 via the mechanical fasteners 32. The second portions of the detachable fasteners 28 are on the front face of the mounting frame 22 for accepting the first portions of the detachable fasteners 16 (FIG. 2) on the back face of the insert frame 12 of the solar panel insert 10. In addition, the removal tab 18 may extend from the back face of the solar panel insert 10. The removal tab 18 may wrap around the outer edge of the insert frame 12 so that it is accessible to a user when the solar panel insert 10 is inserted within the window frame 24 and attached to the mounting frame 22. The area of the solar material 14 of the solar panel insert 10 is substantially equivalent to the open area of the window 20 that will receive the sunlight from the outside.

Figure 6:
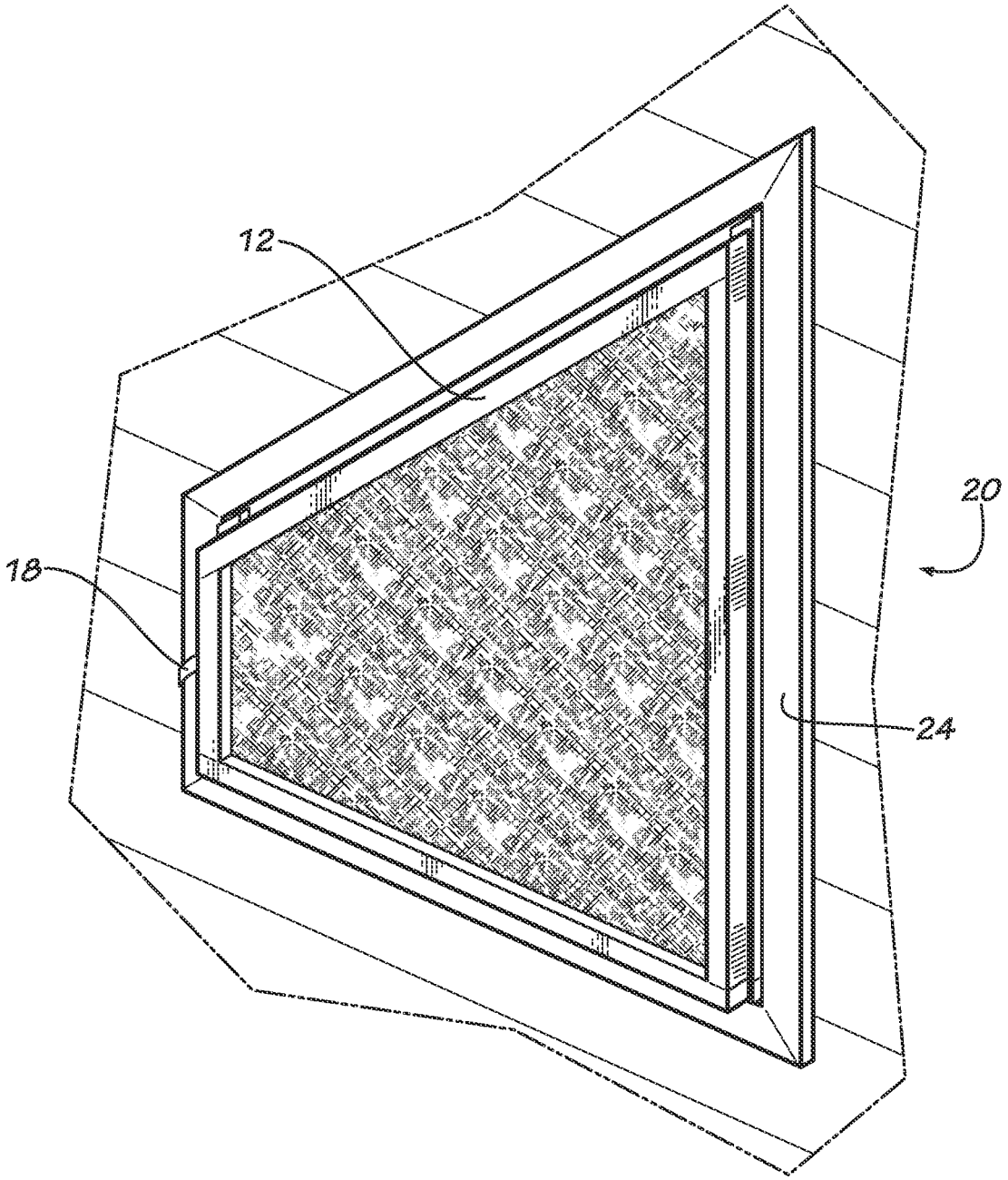
FIG. 6 is a drawing of an example of the solar insert panel of FIG. 1 mounted to a window, according to various embodiments of the present disclosure.

Moving on to FIG. 6, shown is a drawing of an example of the solar panel insert 10 mounted within the window frame 24 of the window 20, according to various embodiments of the present disclosure. The insert frame 12 fits along the edges of the window frame 24. The removal tab 18 protrudes from the outer edge of the insert frame 12 allowing a user to initiate the removal of the solar insert panel 10 for removal and/or storage.

Figure 7:
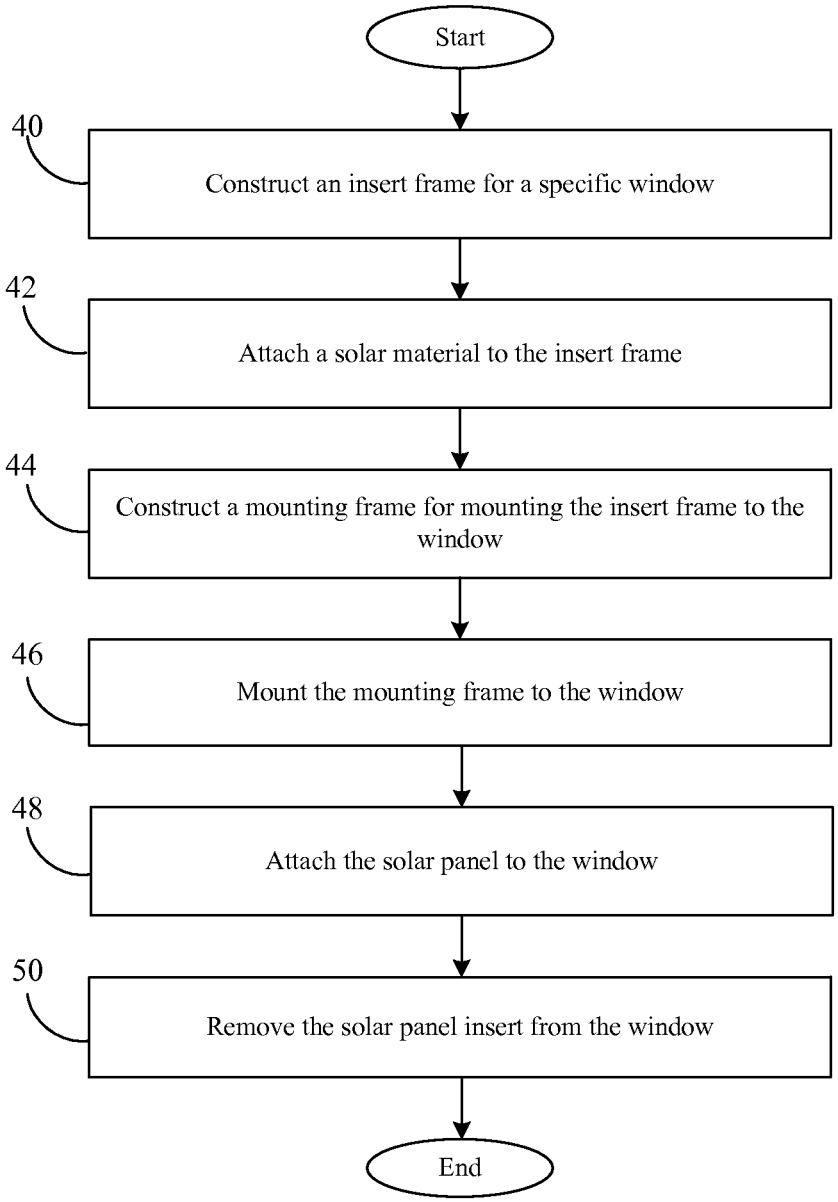
FIG. 7 is a flowchart illustrating methods according to various embodiments of the present disclosure.

Moving on to FIG. 7, shown is a flowchart that provides one example of a method for manufacturing and mounting a solar panel insert 10 for a particular window 20. It is understood that the flowchart of FIG. 7 provides merely an example of the many different types of functional arrangements that may be employed to implement the operation of the methods as described herein.

At reference numeral 40, an insert frame 12 may be constructed and customized for a specific window 20. The window 20 may be a standard window, an architectural window, and/or other type of window. The insert frame 12 may be constructed to fit within a window opening. In one non-limiting example, the insert frame 12 may constructed so that the width is less than ¼" of the window frame width and the height is less than 1" of the window from to allow for heat escape. The insert frame 12 may comprise a wood material, such as, for example, hardwood or other wood material. The insert frame 12 may be assembled with a mechanical fastener such as, for example, screws, nails, bolts, etc. on the butt joints of insert frame 12 or other points of connection. The mechanical fasteners connecting the members of the insert frame 12 may be counter sunk into the frame. In some embodiments, the insert frame 12 may sanded, stained, and/or painted to match the color of the window jamb and/or other desired color.

The removal tab 18 and/or the first portions of the detachable fasteners 16 may also be affixed to the back face of the insert frame 12 via an adhesive and/or other type of fastener such as, for example, a staple, nail, tack, and/or other type of fastener.

At reference numeral 42, the solar material 14 may be stretched and attached to the insert frame 12. The solar material 14 may cover the entire opening defined by the insert frame 12 so that when the solar panel insert 10 is mounted to a window, any sunlight that is projected into an interior space from the window travels through the solar material 14. The solar material 14 may be attached to the insert frame 12 via staples, tacks, nails, adhesive glue, and/or any other type of connector and/or combination of connectors that would securely attach the solar material 14 to the insert frame 12. In some embodiments, the solar material 14 may be affixed to the back of the insert frame 12. In some embodiments, an additional frame may be affixed to the back of the insert frame 12 to conceal the solar material 14 and attachment means that are visible from the back of the insert frame 12. Accordingly, when the solar panel insert 10 is mounted to the window 20, the attachment means for attaching the solar material 14 to the insert frame 12, such as, for example staples, are not visible from the outside and the solar panel insert 10 has a finished appearance.

At reference numeral 44, a mounting frame 22 is constructed for mounting the customized insert frame 12 to the window 20. The mounting frame 22 comprises one or more frame members which are similar in shape to one or more sides of the window frame 24. The dimensions of the one or more frame members of the mounting frame 22 are less than the dimensions of the window frame 24. The mounting frame 22 is constructed to attach to the window frame 24 without obstructing the view from the window pane 26. One or more members of the mounting frame 22 may correspond to one or more of the window edges. For example the mounting frame 22 may correspond to the bottom, left, and right edges of the window 20.

At reference numeral 46, the mounting frame 22 may be mounted to the window 20. The mounting frame 22 may be mounted to the window 20 via mechanical fasteners 32. The mechanical fasteners 32 may securely attach the mounting frame 22 to window jamb and/or other portions of the window frame 24. The mounting frame 22 extends along one or more of the edges of the window 20. At reference numeral 48, the solar panel insert 10 is attached to the mounting frame 22 via first portions of the detachment fasteners 16 and the second portions of the detachment fasteners 28. When attaching the solar panel insert 10 to the mounting frame 22, the removal tab 18 should preferably extend from the back of the insert frame 12 and wrap around at least a portion of a side of the insert frame 12 so that the removal tab 18 protrudes from the front of the solar panel insert 10.

At reference numeral 50, the solar panel insert 10 is removed from the window 20. The solar panel insert 10 may be removed by pulling on the removal tab 18 protruding from the solar panel insert 10. Pulling the removal tab 18 may initiate the separation of the detachable fasteners 16, 28 thereby releasing the solar panel insert 10 from the mounting frame 22. Upon removal, the solar panel insert 10 may be stored as desired.

Although the flowchart of FIG. 7 shows a specific order of execution, it is understood that the order of execution may differ from that which is depicted. For example, the order of execution of two or more steps may be scrambled relative to the order shown. Also, two or more steps shown in succession in FIG. 7 may be executed concurrently or with partial concurrence. Further, in some embodiments, one or more of the blocks shown in FIG. 7 may be skipped or omitted. It is understood that all such variations are within the scope of the present disclosure.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. A solar panel insert for mounting to an irregularly shaped architectural window, comprising:

a mounting frame sized to fit within a window frame of the irregularly shaped architectural window, the mounting frame being configured to be securely mounted to at least two interior sides of the window frame such that a first side of the mounting frame is configured to be secured to a first interior jamb of the window frame and a second side of the mounting frame being configured to be secured to a second interior jamb of the window frame, the mounting frame being shaped substantially equivalent to at least a portion of the window frame, wherein size dimensions of the mounting frame are smaller than size dimensions of the window frame;

an insert frame detachably attached to the mounting frame, the insert frame shaped substantially equivalent to the window frame, wherein size dimensions of the insert frame are smaller than the size dimensions of the window frame such that the insert frame is constructed to fit within the window frame; and a translucent solar fabric securely affixed to the insert frame, the translucent solar fabric covering an opening defined by the insert frame and configured to reduce solar heat and provide ultraviolet (UV) protection.

2. The solar panel insert of claim 1, wherein the insert frame comprises a wood material.

3. The solar panel insert of claim 1, wherein the insert frame comprises a front face and a back face, and wherein the translucent solar fabric is securely attached to the back face of the insert frame.

4. The solar panel insert of claim 1, wherein a back side of the insert frame comprises a plurality of fasteners configured to detachably attach to a plurality of receiving fasteners disposed along a front surface of the mounting frame.

5. The solar panel insert of claim 1, wherein the mounting frame is secured to the at least two interior sides of the window frame via a plurality of screws inserted through an interior of at least two sides of the mounting frame, the at least two sides of the mounting frame being substantially parallel to the at least two interior sides of the window frame.

6. The solar panel insert of claim 4, wherein a combination of a corresponding fastener of the plurality of fasteners and a corresponding receiving fastener of the plurality of receiving fasteners comprise a hook and loop fastener.

7. The solar panel insert of claim 1, wherein the insert frame comprises a removal tab extending from a back side of the insert frame, the removal tab configured to initiate a removal of the insert frame from the mounting frame.

8. The solar panel insert of claim 1, wherein the translucent solar fabric reduces solar properties from a solar source to reduce glare and fading.

9. The solar panel insert of claim 1, wherein a difference between a width of the insert frame and a width of the window frame is about ¼ inch.

10. The solar panel insert of claim 1, wherein a difference between a height of the insert frame and a height of the window frame is about 1 inch.

11. The solar panel insert of claim 1, wherein the insert frame is detachably attached to a front surface of the mounting frame, at least a portion of the insert frame extending transversely beyond a perimeter of the window frame.

12. A solar panel insert apparatus, comprising:

a mounting frame sized to fit within an opening defined by a window frame of an asymmetrical architectural window, the mounting frame being securely mounted to the window frame of the asymmetrical architectural window such that a first side of the mounting frame is secured to an interior side of a first side jamb of the window frame and a second side of the mounting frame is secured to an interior side of a second side jamb of the window frame, the mounting frame being shaped substantially similar to at least a portion of the window frame, an insert frame shaped substantially similar to the window frame, the insert frame being detachably attached to the mounting frame and at least partially embedded within the opening defined by the window frame; and an ultraviolet (UV) limiting solar fabric attached to the insert frame that covers an opening defined by the insert frame, the UV limiting solar fabric designed to reduce features associated with solar light emitted through a window pane of the asymmetrical architectural window, and the UV limiting solar fabric being transparent such that an entity of an area visible through the window pane remains visible through the UV limiting solar fabric.

13. The solar panel insert apparatus of claim 12, further comprising a removal tab extending outwardly from a front face of the insert frame, wherein the removal tab is configured to initiate a detachment of the insert frame from the mounting frame.

14. The solar panel insert apparatus of claim 12, wherein the insert frame is detachably attached to the mounting frame via a plurality of fasteners.

15. The solar panel insert apparatus of claim 14, wherein each fastener of the plurality of fasteners comprises a hook and loop fastener.

16. The solar panel insert apparatus of claim 14, wherein size dimensions of the insert frame are smaller than size dimensions of the window frame.

17. The solar panel insert apparatus of claim 14, wherein the window frame comprises one of the following shapes: a trapezoid, an ellipse, an oval, an octagon, a triangle, an eyebrow, a half circle, a quarter circle, a pentagon, a heptagon, a decagon, or a hexagon.

18. A system, comprising:

an irregularly shaped window; and a solar panel apparatus mounted within a window frame of the irregularly shaped window, the solar panel apparatus comprising:

a first frame securely attached to at least two interior sides of the window frame of the irregularly shaped window, such that a first side of the first frame is securely connected to a first interior side of the window frame via a first mechanical fastener and a second side of the first frame is securely connected to a second interior side of the window frame via a second mechanical fastener, the first frame being sized to fit within the window frame, and a front face of the first frame comprising a plurality of receiving fasteners;

a second frame detachably attached to the first frame via the plurality of receiving fasteners, the second frame being shaped substantially equivalent to the window frame and being sized to fit within the window frame, the second frame being detachably attached to the first frame via individual connecting fasteners of a plurality of connecting fasteners being engaged with a corresponding receiving fastener of the plurality of receiving fasteners, the second frame further comprising a removal tab attached to a back side of the second frame and extending outwardly from a front side of the second frame, the removal tab configured to initiate detachment of the second frame from the first frame; and a solar fabric attached to the second frame and covering an opening defined by the second frame, the solar fabric being transparent such that an outside area visible through a window pane of the irregularly shaped window remains visible through the solar fabric, and the solar fabric being designed to reduce solar features associated with solar light emitted through the window pane from an outside area.

19. The system of claim 18, wherein a difference between a width of the second frame and a width of the window frame is about ¼ inch.

20. The system of claim 18, wherein a difference between a height of the second frame and a height of the window frame is about 1 inch.

21. The system of claim 18, wherein the second frame is detachably attached to a front surface of the first frame, at least a portion of the second frame extending transversely beyond a perimeter of the window frame.

* * * * *